US008038420B2

(12) United States Patent
Uchida et al.

(10) Patent No.: US 8,038,420 B2
(45) Date of Patent: Oct. 18, 2011

(54) VARIABLE DISPLACEMENT VANE PUMP

(75) Inventors: Yukio Uchida, Atsugi (JP); Norikatsu Hoshina, Atsugi (JP); Michiya Hiramoto, Yokohama (JP); Jun Soeda, Fujisawa (JP)

(73) Assignee: Hitachi, Ltd., Tokyo (JP)

( * ) Notice: Subject to any disclaimer, the term of this patent is extended or adjusted under 35 U.S.C. 154(b) by 238 days.

(21) Appl. No.: 12/373,138

(22) PCT Filed: Sep. 25, 2007

(86) PCT No.: PCT/JP2007/068584

§ 371 (c)(1),
(2), (4) Date: Jan. 9, 2009

(87) PCT Pub. No.: WO2008/038638

PCT Pub. Date: Apr. 3, 2008

(65) Prior Publication Data

US 2009/0291008 A1 Nov. 26, 2009

(30) Foreign Application Priority Data

Sep. 26, 2006 (JP) ..... 2006-260021

(51) Int. Cl.
*F04C 2/00* (2006.01)
*F04C 14/18* (2006.01)

(52) U.S. Cl. ..... 418/26; 418/27; 418/30; 418/75; 418/82; 418/133; 417/220

(58) Field of Classification Search ..... 418/24, 418/26–30, 75, 82, 133, 259, 266–268; 417/220
See application file for complete search history.

(56) References Cited

U.S. PATENT DOCUMENTS

| | | | | |
|---|---|---|---|---|
| 6,375,441 | B1 * | 4/2002 | Ichizuki et al. | 418/30 |
| 6,503,068 | B2 * | 1/2003 | Kojima et al. | 418/30 |
| 7,070,399 | B2 * | 7/2006 | Konishi et al. | 418/268 |
| 2002/0064471 | A1 * | 5/2002 | Kojima et al. | 418/30 |

FOREIGN PATENT DOCUMENTS

| | | | |
|---|---|---|---|
| JP | 59-123690 | U | 8/1984 |
| JP | 2000-337267 | A | 12/2000 |
| JP | 2004-245089 | A | 9/2004 |

* cited by examiner

*Primary Examiner* — Theresa Trieu
(74) *Attorney, Agent, or Firm* — Foley & Lardner LLP

(57) ABSTRACT

A variable displacement vane pump that assuredly suppresses seizing of mutually contacting surfaces of a pressure plate and a rotor where the pressure plate is formed, at one side surface thereof that slidably contacts the rotor, with an annular lubricating groove. The lubricating groove is on a seal surface of the side surface at a position between arcuate back pressure grooves formed on the seal surface and a through opening which is formed in a center part of the pressure plate to receive the drive shaft. A radial width of the lubricating groove is set to a range from 10% to 25% of a radial width of the seal surface, and a distance from a center of the radial width of the lubricating groove to an inner cylindrical surface of the through opening is set to a range from 24% to 70% of the radial width of the seal surface.

5 Claims, 8 Drawing Sheets

EFFECT BY DEPTH OF LUBRICATING GROOVE

VARIABLE DISPLACEMENT VANE PUMP

TECHNICAL FIELD

The present invention relates to improvement in variable displacement vane pumps used for a power steering device of a motor vehicle.

BACKGROUND ART

For example, as a conventional variable displacement vane pump applied to a power steering device of a motor vehicle, a vane pump such as the vane pump disclosed in the latter mentioned patent reference 1 has been known.

The variable displacement vane pump of the reference comprises a cam ring that is swingably received in a receiving space formed in a front body, a rotor that is rotatably received in the cam ring and has vanes retractably and projectably received in radially extending slots formed in the rotor, a pressure plate that contacts an inside surface of the rotor, and a rear body that closes an open side of the receiving space of the front body.

The rotor has axially extending back pressure through bores respectively opened to the slots, and the pressure plate has, on an inside surface thereof facing the back pressure through bores, a generally arcuate back pressure groove that is connected a discharge chamber in which a pump discharge pressure is reserved. By introducing the pump discharge pressure to the back pressure bores through the back pressure groove, the vanes are forced to project from the corresponding slots and contact to an inner cylindrical surface of the cam ring, so that pump chambers are formed each being defined by mutually facing adjacent two vanes, an outer cylindrical surface of the rotor, the inner cylindrical surface of the cam ring, an outside surface of the pressure plate and an inside surface of the rear body.

The pressure plate and the rotor have, at respectively contacting surfaces thereof, radially spaced several annular zones each having a plurality of dimples depressed, each dimple having a generally arc-shaped cross section. The dimples function to lubricate the respective contact surfaces of the pressure plate and the rotor by temporarily reserving a high pressure oil that has entered thereinto from the back pressure groove of the pressure plate through a very fine clearance defined between the pressure plate and the rotor. With such dimples, undesired seizing of the mutually contacting surfaces of the pressure plate and the rotor is suppressed.

Patent reference 1: Laid open Japanese Patent Application (Tokkai) 2000-337267

DISCLOSURE OF THE INVENTION

Task to be Solved by the Invention

In recent years, for much reducing an assist power of a steering action in the power steering device, variable displacement vane pumps having a high pump discharge pressure are in great demand.

However, when, in the conventional variable displacement vane pumps, the pump discharge pressure is set high, the pressure plate is pressed against the rotor with a higher pressing force, and thus, a seizing of the mutually contacting surfaces of the pressure plate and the rotor has not been suppressed by only providing the contacting surfaces with the above-mentioned dimples, which has been a severe problem.

The present invention is provided by taking the above-mentioned technical task into consideration and provides a variable displacement vane pump which assuredly suppresses the seizing between the mutually contacting surfaces of the pressure plate and the rotor.

Means for Solving the Task

According to one embodiment, there is provided a variable displacement vane pump which comprises a pump body that includes a front body having a receiving space defined therein and a rear body attached to the front body to close the receiving space; a drive shaft that passes through the pump body and rotatably supported in the same; a rotor that is mounted on an outer cylindrical surface of the drive shaft and received in the receiving space; a plurality vanes that are retractably and projectably received in a plurality of slots formed in the rotor in a manner to extend radially outward; a cam ring that is swingably arranged about the rotor to form a plurality of pump chambers, each being defined by adjacent two vanes, the rotor, and a part of the cam ring; a pressure plate that is arranged in a manner to be put between inside surfaces of the rotor and cam ring and a bottom surface of the receiving space and biased toward and pressed against the inside surface of the rotor to slidably contact with the same by a pump discharge pressure led from the bottom side of the receiving space; first and second fluid pressure chambers that are formed around the cam ring to control an eccentric amount of the cam ring; a pressure control means that controls the pressure in the first or second fluid pressure chamber; and an arrangement that includes an intake port that is provided by one of an inside surface of the rear body and the inside surface of the pressure plate facing the rotor and opened to a range where each pump chamber increases the volume; a discharge port that is provided by the above-mentioned selected inside surface and opened to a range where each pump chamber decreases the volume; an axially extending through opening that is formed in the pressure plate for receiving the drive shaft; a back pressure groove that is formed on the inside surface of the pressure plate at an area that slidably contacts the rotor to feed a pressurized fluid to bottom portions of the slots; a seal surface.

According to the invention, because the lubricating groove is constructed to the satisfy the above-mentioned condition, the mutually contacting surfaces of the rotor and pressure plate can be effectively lubricated even when the discharging pressure of the pump is set to a marked level. Thus, seizing between the rotor and the pressure plate is assuredly suppressed while suppressing lowering of the sealing performance of the seal surface.

According to the embodiment of paragraph [0009], characterization is so made that a depth of the lubricating groove is set to 25% or more of the radial width of the lubricating groove.

According to the invention, because the depth of the lubricating groove is set to satisfy the above-mentioned condition, it is possible to feed the lubricating groove with a large quantity fluid, and thus increase in lubrication performance of the lubricating groove is achieved. With this, the seizing of the rotor and pressure plate is much assuredly suppressed.

According to the embodiment of paragraph [0009], characterization is so made that the radial width of the lubricating groove is set to a range from 15% to 20% of the radial width of the seal surface.

According to the invention, because the radial width of the lubricating groove is set to satisfy the above-mentioned condition, only actually needed degree of lubrication is obtained without enlarging the radial width of the lubricating groove unnecessarily, and thus, lubrication performance and sealing performance are both obtained at the same time. With this, an optimum lubrication operation is carried out by the mutually contacting surfaces of the rotor and pressure plate, and thus seizing between the rotor and the pressure plate is assuredly prevented.

According to the embodiment of paragraph [0009], characterization is so made that the distance from the center of the radial width of the lubricating groove to the inner cylindrical surface of the through opening is set to a range from 30% to 45% of the radial width of the seal surface.

According to the invention, because the distance from the center of the radial width of the lubricating groove to the inner cylindrical surface of the through opening is set to the above-mentioned condition, the radial positioning of the lubricating groove is not excessively displaced and thus, a suitable sealing surface is obtained from the seal surface while obtaining an actually needed lubrication on the mutually contacting surfaces of the rotor and pressure plate. With this, leakage of the working fluid from the back pressure groove is much more effectively suppressed.

BEST MODE(S) FOR CARRYING OUT THE INVENTION

In the following, embodiments of the present invention, which are variable displacement vane pumps according to the present invention, will be described in detail with reference to the accompanying drawings. It is to be noted that the embodiments or the variable displacement vane pumps of the invention are those that are applied to a power steering device of a motor vehicle, like in the above-mentioned conventional pump.

That is, as is seen from FIGS. 7 and 8, the variable displacement vane pump comprises a pump body 1 that is provided by joining a front body 2 and a rear body 3, an annular adapter ring 4 that is tightly put in a receiving space 2*a* formed in the pump body 1, an annular cam ring 6 that is received in an oval space formed in the adapter ring 4 in a manner to be swingable about a swing fulcrum pin 5, and a rotor 8 that is rotatably received in the cam ring 6 and fixed to a drive shaft 7 that passes through the pump body 1.

The cam ring 6 has a width in an axial direction that is slightly smaller than the adapter ring 4 and the cam ring 6 is arranged in the receiving space 2*a* while keeping an eccentric position relative to the rotor 8. Furthermore, the cam ring 6 is arranged to separate a first fluid pressure chamber 10*a* and a second fluid pressure chamber 10*b* through the swing fulcrum pin 5 and a seal member 9 that is placed at a position opposed to the fulcrum pin 5.

The rotor 8 is shaped like a disc and has a width in an axial direction that is generally the same as that of the cam ring 6. Furthermore, the rotor 8, more specifically, opposed side surfaces of the rotor 8 in an axial direction are put or sandwiched, together with the cam ring 6, between the rear body 3 and a circular pressure plate 11 of sintered material that is set on a bottom part of the receiving space 2*a* of the front body 2 keeping a slight clearance "C" between the pressure plate and the rotor 8 as is seen from FIG. 2.

The rotor 8 is arranged to rotate in a direction (counterclockwise direction) as is indicated by an arrow in FIG. 9 when the drive shaft 7 is driven by an engine (not shown). The rotor has in an outer cylindrical portion thereof a plurality of slots 8*a* that extend radially outward and are arranged at equally spaced positions. In the slots 8*a*, there are received vanes 12 that are projectable radially outward toward the inner cylindrical surface of the cam ring 6. A radially inside end of each slot 8*a* is integrally formed with a back pressure chamber 8*b* that has a generally cylindrical shape.

In a space provided between the cam ring 6 and the rotor 8, there is defined a pump chamber 13 by two adjacent vanes 12, and by swinging the cam ring 6 about the swing fulcrum pin 5, the volume of the pump chamber 13 is increased or decreased.

In the second fluid pressure chamber 10*b*, there is installed a compression coil spring 14, so that the cam ring 6 is constantly biased toward the first fluid pressure chamber 10*a*, that is, in a direction to maximize the volume of the pump chamber 13.

Furthermore, as is seen from FIGS. 3 and 8, an inside surface 3*a* of the rear body 3 at the side of the rotor 3 in an intake range "A" where the volume of each pump chamber 13 gradually increases in response to rotation of the rotor 8 is formed with a generally arcuate first intake port 15. The first intake port 15 is formed at its middle portion with a first intake opening 15*a* that is opened to an intake passage 16 formed in the rear body 3, so that the working fluid led into the intake passage 16 from a reservoir tank (not shown) through an intake pipe 17 is led to each pump chamber 13 through the first intake opening 15*a*.

Furthermore, as is seen from FIG. 7, at a generally middle position of the inside surface 3*a* of the rear body 3, there is formed a recess 3*b* that bears one end portion of the drive shaft 7, and at a bottom part of the recess 3*b*, there is formed a return passage 18 that is connected with the intake passage 16. The return passage 18 is so constructed as to permit the working fluid that has been led into the recess 3*b* after coming through the slight clearance "C" defined between the inside surface 3*a* of the rear body 3 and the outside surface 8*c* of the rotor 8 at the side of the rear body 3 to return to the intake passage 16 thereby leading the working fluid to the first intake port 15 through the first intake opening 15*a*.

While, as is seen from FIGS. 3 and 7, an inside surface 11*a* of the pressure plate 11 at the side of the rotor 8 in a discharge range "B" where the volume of each pump chamber 13 gradually reduces in response to rotation of the rotor 8 is formed with a generally arcuate first discharge port 19 and a plurality of discharge openings 20 that are connected to the first discharge port 19. Pressurized fluid discharged from the pump chambers 13 is led through the first discharge port 19 and the discharge openings 20 into a discharge side pressure chamber 21 that is formed in a bottom part of the receiving space 2*a* of the front body 2, and the pressurized fluid is then led to a hydraulic power cylinder of a power steering device (not shown) through a discharge passage (not shown) formed in the pump body 1.

The inside surface 11*a* of the pressure plate 11 is formed at a portion facing the first intake port 15 of the rear body 3 with a second intake port 22 that has a substantial same shape as the first intake port 15. The second intake port 22 is formed at a middle portion thereof with a second intake opening 22*a* that is opened to a relief passage 23 formed in the front body 2, so that the working fluid returned from a relief valve 40 of an after-mentioned fluid control valve 30 through the relief passage 23 is led to each pump chamber 13 through the second intake opening 22*a*.

Furthermore, the inside surface 3*a* of the rear body 3 is formed at a portion facing the first discharge port 19 of the pressure plate 11 with a second discharge port 24 that has a substantially same shape as the first discharge port 19. From both ends of the second discharge port 24, there extend respective narrow grooves 25*a* and 25*b* each being sufficiently small as compared with the second discharge port 24, and the narrow grooves 25*a* and 25*b* extend in a circumferential direction to positions near the ends of the first intake port 15, so that production of noises that would be caused by sudden pressure change in each pump chamber 13 can be suppressed.

As will be understood from the above description, by providing the respective inside surfaces 3*a* and 11*a* of the rear body 3 and the pressure plate 11 with the first and second intake ports 15 and 22 and the first and second discharge ports 19 and 24 in which each pair is arranged symmetrically in an axial direction, the pressure balance between axially opposed portions of each pump chamber 13 is kept.

As is shown in FIG. 7, the pressure plate 11 is formed at a center portion thereof with a through opening 26 through which the drive shaft 7 passes, and the front body 2 is formed at a bottom part of the receiving space 2*a* with a shaft hole 2*b* for bearing the other end of the drive shaft 7, the shaft hole 2*b* extending coaxially with the through opening 26. These through opening 26 and shaft hole 2*b* have each an inside diameter that is slightly larger than an outside diameter of the drive shaft 7, and thus between each of inner cylindrical surfaces of the through opening 26 and the shaft hole 2*b* and an outer cylindrical surface of the drive shaft 7, there is defined a cylindrical oil passage 27 into which the working fluid that has flowed out from the clearance "C" between the inside surface 11*a* of the pressure plate 11 and the inside surface 8*d* of the rotor 8 placed at the side of the pressure plate 11 is led.

The shaft hole 2*b* is provided at a generally middle position in an axial direction with a seal member 28 of which inside surface is formed with an annular groove 28*a*, so that a clearance between the inner cylindrical surface of the shaft hole 2*b* and the outer cylindrical surface of the drive shaft 7 is sealed. Furthermore, in the front body 2, there is formed a return passage 29 of which one end is opened to the annular groove 28*a* of the seal member 28 and of which other end is connected to the relief passage 23, so that the working fluid led into the cylindrical oil passage 27 is returned to the relief passage 23 through the annular groove 28*a* thereby to re-lead the working fluid to the second intake port 22 through the second intake opening 22*a*.

Furthermore, as is seen in FIG. 7, the front body 2 is provided at its upper inner portion with a flow control valve 30 that controls a discharged amount of the fluid from the pump, the valve being arranged to extend perpendicular to the drive shaft 7. As is seen from FIG. 8, the flow control valve 30 comprises a spool element 32 that is slidably received in a valve hole 31 formed in the front body 2, a valve spring 34 that biases the spool element 32 leftward in the drawing thereby to contact the element 32 to a plug 33 of the valve hole 31, a high pressure chamber 35 that is defined between the plug 33 and a leading end of the spool element 32 to receive therein a fluid pressure appearing at an upstream side of a metering orifice (not shown), that is, a pressurized fluid that has been led into the discharge side pressure chamber 21 and a medium pressure chamber 36 that installs the valve spring 34 and receives therein the fluid pressure appearing at a downstream side of the metering orifice, so that when a pressure difference between the medium pressure chamber 36 and the high pressure chamber 35 exceeds a predetermined value, the spool element 32 is moved rightward in the drawing against the biasing force of the valve spring 34.

When the spool element 32 is at a left position in FIG. 8, the first fluid pressure chamber 10*a* is in communication with a low pressure chamber 37 defined around the spool element 32 through a communicating passage 38 that communicates the first fluid pressure chamber 10*a* to the valve hole 31. Into the low pressure chamber 37, there is introduced a low pressure from the intake passage 16 through a low pressure passage (not shown) branched from the intake passage 16.

When the spool element 32 is moved rightward in the drawing due to the work of a pressure difference between the chambers 35 and 36, the low pressure chamber 37 is gradually blocked and the first fluid pressure chamber 10*a* becomes communicated with the high pressure chamber 35 thereby to receive therein a highly pressurized fluid. That is, into the first fluid pressure chamber 10*a*, there are selectively introduced a fluid pressure of the low pressure chamber 37 and a fluid pressure appearing at an upstream side of the metering orifice.

While, as is shown in FIG. 2, the second fluid pressure chamber 10*b* is communicated with the first intake port 15 through a communicating passage 39 that is formed in the inside surface 3*a* of the rear body 3 and extends radially outward from a position near the second fluid pressure chamber 10*b* of the first intake port 15, so that the second fluid pressure chamber 10*b* is forced to constantly receive a fluid pressure (low pressure) of the intake side.

When the pressure in the medium pressure chamber 36 reaches a predetermined value, that is, when the working pressure in the above-mentioned power cylinder reaches the predetermined value, the relief valve 40 installed in the spool element 32 is opened to release the pressurized fluid to the relief passage 23.

Furthermore, as is seen from FIGS. 3 and 7, the inside surface 11*a* of the pressure plate 11 is formed, at a portion facing the back pressure chamber 8*b* in the intake range "A", with an arcuate first intake side back pressure groove 41 that has a predetermined length in a circumferential direction. The first intake side back pressure groove 41 is formed at both ends with respective communicating bores 41*a* that are connected to the above-mentioned discharge side pressure chamber 21, so that part of the pressurized fluid in the discharge side pressure chamber 21 is led to the respective back pressure chambers 8*b* through the communicating bores 41*a*.

Furthermore, the inside surface is formed, at a portion facing the back pressure chamber 8*b* in the intake range "A", with a first discharge side back pressure groove 42 that has substantially the same shape as the above-mentioned first intake side back pressure groove 41, the first discharge side back pressure groove 42 being placed on a common imaginary circle at a position diametrically opposed to the position where the first intake side back pressure groove 41 is placed (symmetrically upper and lower positions in FIG. 3). In the first discharge side back pressure groove 42, there is arranged an axially extending orifice 42*a* that is connected with the discharge side pressure chamber 21, so that the pump discharging pressure is led into the groove 42 through the orifice 42*a*.

As is seen from FIG. 3, on the inside surface 11*a* of the pressure plate 11, there is defined around the through opening 26 a generally circular seal surface 43 due to provision of the first intake side back pressure groove 41 and the first discharge side back pressure groove 42, and on the seal surface 43, there is formed a circular lubricating groove 44 for lubricating a contacting with the rotor 8.

As is seen from FIGS. 1 and 3, the lubricating groove 44 has a generally rectangular cross section when viewed in a lateral direction and extends continuously in a circumferential direction without cuts, so that the seal surface 43 is partitioned into an outside seal surface 43*a* and an inside seal surface 43*b*. The lubricating groove 44 is positioned in a zone of the seal surface 43 where a distance "L" from an inner cylindrical surface 26*a* of the through opening 26 to a center "P" of a radial width of the lubricating groove 44 indicates 24% to 70% of a total radial width "W1" of the seal surface 43. In the illustrated embodiment, the distance "L" of the center "P" of the width of the lubricating groove 44 is set to 30% to 45% of the total width "W1", which was proved by satisfied results of an after-mentioned experiment.

A radial width "W2" of the lubricating groove 44 is set to 10% to 25% of the total radial width "W1" of the seal surface 43, and the depth "D" is set to a range that is larger than 25% of the total width "W1" of the seal surface 43. In the illustrated embodiment, the radial width "W2" of the lubricating groove 44 is set to 15% to 20% of the total radial width "W1" of the seal surface 43, which was proved by satisfied results of an after-mentioned experiment.

As is seen from FIGS. 4 and 7, a bottom surface of the receiving space 2*a* of the front body 2 is formed with an annular seal holding groove 45 that has a generally mushroom-shaped cross section when viewed in an axial direction. As is indicated by a phantom line in FIG. 4, with respect to the outside surface 11*b* of the bottom side of the receiving space 2*a* of the pressure plate 11, the seal holding groove 45 has an inside part that extends around a lower half of the through opening 26 and an outside part of which opposed ends radially outward extend from opposed peripheral ends of an upper half of the through opening 26 and extend toward each other to enclose a center portion of the second intake port 22. The seal holding groove 45 has a seal member 46 of rubber material tightly fixed thereto.

As is seen from FIG. 4, at the outside surface 11*b* of the pressure plate 11, due to presence of the seal member 46, inside and outside portions of a peripheral area of the second intake opening 22*a* form respectively a low pressure zone "Lp" that communicates with the intake side and a high pressure zone "Hp" that communicates with the discharge side, and as is seen from FIG. 7, to the low pressure zone "Lp" enclosed by the seal member 46, there is applied the fluid pressure (low pressure) that has been led from the relief passage 23, and to the high pressure zone "Hp" provided around the seal member 46, there is applied the fluid pressure (high pressure) that has been led from the discharge side pressure chamber 21.

While, as is seen from FIG. 2, the inside surface 3*a* of the rear body 3 is formed, at a position that faces the first intake side back pressure groove 41 of the pressure plate 11, with a second intake side back pressure groove 47 that has substantially the same shape as the above-mentioned first intake side back pressure groove 41. Furthermore, the rear body 3 is formed, at a position that faces the first discharge side back pressure groove 42, with a second discharge side back pressure groove 48 that has substantially the same shape as the above-mentioned first discharge side back pressure groove 42, the second discharge side back pressure groove 48 being placed generally symmetrical to the second intake side back pressure groove 47 (symmetrically upper and lower positions in FIG. 2). The second intake side back pressure groove 47 and the second discharge side back pressure groove 48 have respective ends that are connected through communicating grooves 49*a* and 49*b* whose depth is small as compared with the grooves 47 and 48.

On the inside surface 3*a* of the rear body 3, there is formed a generally circular seal surface 50 around the recess 3*b*, which is defined by the second intake side back pressure groove 47, the second discharge side back pressure groove 48 and the communicating groves 49*a* and 49*b*. The seal surface 50 is formed, at a portion facing the lubricating groove 44, with a lubricating groove 51 that has substantially the same shape as the lubricating groove 44.

In the following, unique operation of the variable displacement vane pump according to the embodiment will be described with reference to FIG. 2.

Upon operation, in the variable displacement vane pump, the pressure plate 11 is biased toward the rotor 8 by the pump discharging pressure, so that the inside surface 11*a* of the pressure plate 11 is entirely in contact with the inside surface 8*d* of the rotor 8. Under this condition, the above-mentioned clearance "C" is produced between the inside surface 11*a* of the pressure plate 11 and the inside surface 8*d* of the rotor 8, so that the pressure plate 11 is forced to have its center area maximally projected thereby causing a peripheral area of the through opening 26 to be highly pressed by the inside surface 8*d* of the rotor 8.

However, since the seal surface 43 that would be easily subjected to unbalanced wear when the inside surface 11*a* of the pressure plate 11 slidably contacts the rotor 8 is formed with the lubricating groove 44 that fulfills the above-mentioned dimensional condition, the following desired fluid flow is made. That is, as is indicated by a broken line in FIG. 1, the pressurized fluid in the first intake side back pressure groove 41 and the first discharge side back pressure groove 42 is forced to flow to the outside seal surface 43*a* through the clearance "C". Then, the pressurized fluid led between the outside seal surface 43*a* and the rotor 8 is led into the lubricating groove 44 while lubricating contracting portions between outside seal surface 43*a* and the inside surface 8*d* of the rotor 8.

Then, the pressurized fluid led into the lubricating groove 44 is temporarily kept therein and then led toward the inside seal surface 43*b* from the lubricating groove 44. Then, the pressurized fluid led between the inside seal surface 43*b* and the rotor 8 is led to a radially inner side of the pressure plate 11, that is, to the above-mentioned cylindrical oil passage 27 while lubricating contacting portions between the inside seal surface 43*b* and the inside surface 8*d*. Like this, the pressurized fluid led into the cylindrical oil passage 27 is led into the relief passage 23 through the annular groove 28*a* of the seal member 28 and the return passage 29, and returned back to the intake side pump chamber 13 through the second intake opening 22*a*.

As is described hereinabove, by providing the seal surface 43 of the inside surface 11*a* of the pressure plate 11 with the above-mentioned lubricating groove 44, the above-mentioned lubrication operation is achieved. In particular, by setting the distance "L" to the center "P" of the radial width of the lubricating groove 44, the radial width "W2" and the depth "D" to the above-mentioned ranges, seizing of an outer peripheral area of the through opening 26 at a side of the inside surface 11*a* of the pressure plate 11 is assuredly suppressed due to an excellent lubrication operation. This excellent lubrication operation was proved by the results of an endurance test of a pump device, which will be described in the following.

FIG. 5 is a graph showing the results of the endurance test in which the distance "L" to the center "P" of the radial width of the lubricating groove 44 and the radial width "W2" were randomly varied. In the graph, cases wherein the outer peripheral area of the through opening 26 at the side of the inside surface 11*a* was not subjected to seizing are judged or indicated by "O", while cases wherein the outer peripheral area was subjected to seizing are judged or indicated by "X".

That is, in case wherein the distance "L" to the center "P" of the radial width of the lubricating groove 44 was set to 24% or less or 70% or more of the radial width "W1" of the seal surface 43, the lubricating groove 44 was displaced too much in a radial direction, and thus, the seal area of the outside seal surface 43*a* or the inside seal surface 43*b* became so small resulting in that the sealing performance of one of the seal surfaces 43*a* and 43*b* was excessively lowered and thus the lubrication operation of the lubricating groove 44 was insufficient.

While, in case wherein the distance "L" to the center "P" of the radial width of the lubricating groove 44 was set to a range from 24% to 70% of the radial width "W1" of the seal surface 43, satisfied lubrication operation of the lubricating groove 44 was achieved. Particularly in case wherein the distance "L" was set to a range from 30% to 45% of the radial width "W1", excessive displacement of the radial positioning of the lubricating groove 44 was not induced and thus suitable seal areas of the outside seal surface 43*a* and the inside seal surface 40*b* were obtained resulting in excellent seal performance and satisfied lubrication operation.

While, in case wherein the radial width "W2" of the lubricating groove 44 was set to 10% a or less of the radial width "W1" of the seal surface 43, the radial width W2" became too small and thus the groove could not hold the fluid sufficiently resulting in that a satisfied lubrication operation of the lubricating groove 44 was not obtained. While, in case wherein the radial width "W2" of the lubricating groove 44 was set to 25% or more of the radial width "W1" of the seal surface 43, the seal area of the seal surface 43 became excessively small and thus the sealing performance of the seal surface 43 was excessively lowered resulting in unsatisfied lubrication operation of the lubricating groove 44.

While, in case wherein the radial width "W2" of the lubricating groove 44 was set to a range from 10% to 25% of the radial width "W1" of the seal surface 43, satisfied lubrication operation of the lubricating groove 44 was obtained. As is shown by a slashed portion of FIG. 5, in case wherein the radial width "W2" was set to a range from 15% to 20% of the radial width "W1", a suitable lubrication amount was obtained without increasing the radial width of the lubricating groove 44 to an unnecessarily large degree and thus the lubrication performance and the sealing performance were obtained at the same time inducing excellent lubrication operation.

By the above-mentioned experiment, it became apparent that, for obtaining a satisfied lubrication operation by the lubricating groove 44, the distance "L" to the center "P" of the radial width of the lubricating groove 4 and the radial width "W2" are arranged within a zone "G" enclosed by a thicker line of FIG. 5.

FIG. 6 is a graph depicting the results of an endurance test wherein in the zone "G", only the depth "D" of the lubricating groove 44 was changed while fixing the above-mentioned parameters "L" and "W2" to certain values. Like in the above-mentioned experiment, cases in which no seizing appeared on the sliding surface of the pressure plate 11 are indicated or judged by "O", while cases in which seizing appeared on the sliding surface are indicated or judged by "X".

That is, in case wherein the depth "D" of the lubricating groove 44 was set to 25% of the radial width "W2" of the lubricating grove 44, the depth of the lubricating groove 44 became too small and thus the groove failed to hold therein a satisfied amount of fluid resulting in failure in exhibiting a satisfied lubrication operation of the lubricating groove 44.

While, in case wherein the depth "D" of the lubricating groove 44 was set to 25% or more of the radial width "W2" of the lubricating groove 44, satisfied lubrication operation of the lubricating grove 44 was obtained. As a result, it became apparent that the range of the depth "D" that assures a satisfied lubrication operation by the lubricating groove 44 was arranged above the thicker line of FIG. 6, that is, a range larger than 25% of the radial width "W2".

Accordingly, in the above-mentioned embodiment, by providing the seal surface 43 of the pressure plate 11 with the lubricating groove 44 that satisfies the above-mentioned set conditions of the radial position "L" and radial width "W2", undesired seizing of the pressure plate 11 to the rotor 8 is assuredly prevented even if the pump discharging pressure is set high, because the outer peripheral part of the through opening 26 of the inside surface 11*a* of the pressure plate 11, which is strongly pressed against the rotor 8, is effectively lubricated while effectively lowering deterioration of the sealing between the inside surface 8*d* of the rotor 8 and the seal surface 43.

Particularly, when the distance "L" to the center "P" of the radial width of the lubricating groove 44 is set to the range from 30% to 45% of the radial width "W1" of the seal surface 43 and at the same time the radial width "W2" of the lubricating groove 44 is set to the range from 15% to 20% of the radial width "W1" of the seal surface 43, the lubricating groove 44 is prevented from taking an excessively displaced radial positioning and the seal surfaces 43*a* and 43*b* can obtain suitable sealing surfaces, and thus, satisfied lubrication is obtained by only an amount of fluid actually needed without increasing the radial width of the lubricating groove 44 to an unnecessarily large degree. Accordingly, suppressing of lowering in pumping efficiency which would be inevitably caused by leakage of the pressurized fluid and lubrication between respective sliding surfaces of the rotor 8 and pressure plate 11 are most effectively achieved.

Furthermore, by setting the depth "D" of the lubricating groove 44 to a range that is larger than 25% of the radial width "W1" of the seal surface 43, the lubricating groove 44 can hold a larger amount of pressurized fluid and thus the lubricating performance of the lubricating groove 44 can be increased, which assuredly prevents undesired seizing of the pressure plate 11 to the rotor 8.

Furthermore, at the inside surface 3*a* of the rear body 3, substantially same operation as the above-mentioned lubrication operation at the inside surface 11*a* of the pressure plate 11 is obtained since the clearance between the seal surface 50 and the outside surface 8*c* of the rotor 8 is lubricated by the pressurized fluid that has leaked thereto through the lubricating groove 51 from the second intake side back pressure groove 47 and second discharge side back pressure groove 48, and the pressurized fluid is returned back to the intake side from the recess 3*b* through the return passage 18.

Furthermore, by separating the outer peripheral part of the second intake opening 22*a* of the outside surface 11*b* of the pressure plate 11 into inside and outside areas with usage of the seal member 46, the inside (viz., the side facing the rotor 8) of an upper half of the pressure plate 11 is applied with the intake pressure and at the same time the outside (viz., the side facing the bottom portion of the receiving space 2*a*) of the same is applied with a low-pressurized working fluid that has returned from the relief valve 40 and the return passage 29, and thus the fluid pressure applied to the axially opposed both sides 11*a* and 11*b* can be balanced. That is, undesired phenomenon wherein the upper half portion of the pressure plate 11 is deformed or depressed toward the rotor 8 is suppressed, and thus, increase in unbalanced wearing of the seal surface 43, which would be caused by the high pressing of the upper half portion of the inside surface 11*a* of the pressure plate 11 against the rotor 8, is suppressed or lowered.

Furthermore, since the lubricating groove 44 has a generally annular cross section when viewed in an axial direction, the working fluid is permitted to make a recirculation flow in the lubricating groove 44, and thus, the lubrication performance of the lubricating groove 44 is further increased.

Furthermore, the pressure plate 11 is produced by a sintered material and by using a die forming technique, the lubricating groove 44 can take various shapes freely.

Furthermore, since the sintered material is porous, the working fluid can be accumulated in the minute pores formed in the pressure plate 11 and thus the lubricating performance exhibited when the pressure plate 11 slidably contacts the rotor 8 is much increased.

FIG. 9 shows a second embodiment of the present invention. The basic construction of this embodiment is the same as that of the above-mentioned first embodiment, and in the second embodiment, modification is made to the lubricating groove 44 of the first embodiment.

That is, at a part corresponding to the rest part of the low pressure zone "Lp" defined by the seal member 46 of the above-mentioned first embodiment, the lubricating groove 44 in the second embodiment is formed with a circumferentially extending narrower groove part 52 that has a radial width "W3" smaller than the radial width "W2" of the lubricating groove 44.

Accordingly, in the second embodiment, a portion where both the side surfaces 11*a* and 11*b* of the pressure plate 11 are pressed by the discharge side fluid pressure (higher pressure), that is, a portion of which deformation tends to increase upon appearance of a pressure difference between the side surfaces 11*a* and 11*b* achieves a satisfied lubrication performance at a portion that contacts the rotor 8, and a portion that is pressed by the intake side fluid pressure (lower pressure), that is, a portion of which deformation does not increase so large even upon appearance of the pressure difference between the side surfaces 11*a* and 11*b* exhibits a satisfied sealing performance to the mutually contacting surfaces of the pressure plate 11 and the rotor 8 in the low pressure zone "Lp" due to provision of the narrower groove part 52.

Accordingly, also in the second embodiment, substantially same operation effects as those of the first embodiment are obtained. In addition to this, at a portion that needs a heavy lubrication, seizing is suppressed due to a satisfied lubrication at the mutually contacting surfaces and at a portion that needs only a light lubrication, leakage of the pressurized fluid from the back pressure grooves 41 and 42 is suppressed due to the increased sealing between the mutually contacting surfaces, so that the lubrication of the mutually contacting surfaces and suppressing of lowering of pumping effect which would be caused by the fluid leakage are both achieved effectively.

FIG. 10 shows a third embodiment of the present invention. This third embodiment has no part that corresponds to the above-mentioned narrower groove part 52 of the first embodiment and has as a substitute for the part 52 an enlarged seal surface 53, and in the third embodiment, the lubricating groove 44 has a generally C-shaped cross section when viewed in an axial direction.

That is, in the pressure plate 11, only portions where lubrication is absolutely necessary are provided with the lubricating groove 44, and portions where the lubrication is not absolutely necessary are formed with the enlarged seal surface 53, so that the mutually contacting surfaces of the pressure plate 11 and rotor 8 are satisfied with both the lubrication and sealing performance. Thus, the lubrication of the mutually contacting surfaces and suppressing of lowering of pumping effect which would be caused by the leakage of the pressurized fluid are both achieved effectively.

FIG. 11 shows a fourth embodiment of the present invention. The basic construction of this embodiment is the same as that of the above-mentioned first embodiment, and in this fourth embodiment, modification is made to the lubricating groove 44 of the first embodiment.

That is, at a part corresponding to the rest part of the low pressure zone "Lp" defined by the seal member 46 of the above-mentioned first embodiment, the lubricating groove 44 of the fourth embodiment is formed with a straight groove part 54 that extends leftward and rightward in FIG. 11 and has a radial distance "L1" smaller than the distance "L" to the center "P" of the radial width of the lubricating groove 44.

Accordingly, also in this embodiment, substantially same operation effects as those of the first embodiment are obtained. In addition to this, due to provision of the straight groove part 54 in the low pressure zone "Lp" of the lubricating groove 44, the outside seal surface 43*a* is expanded in the low pressure zone "Lp" where axial deformation of the pressure plate 11 is not easily carried out, and thus leakage of the pressurized fluid from the first intake side back pressure groove 41 is reduced thereby providing the lubricating groove 44 with a suitable lubrication performance as well as a suitable sealing performance.

In the following, technical thoughts possessed by the above-mentioned various embodiments, will be described.

A variable displacement vane pump which is characterized in that the lubricating groove has a generally arcuate cross section when viewed in a lateral direction.

According to the invention, since the lubricating groove is so constructed as to have a generally arcuate cross section when viewed in a lateral direction, it is possible to reduce a flow resistance produced when a fluid flows through the lubricating groove, and thus, improvement in lubrication of the working fluid in the lubricating groove is obtained.

A variable displacement vane pump according to paragraph [0077], which is further characterized in that the lubricating groove is constructed to have a generally annular cross section when viewed in an axial direction.

According to the invention, since the lubricating groove is constructed to have a generally annular cross section when viewed in an axial direction, it is possible to circulate the working fluid in the lubricating groove, and thus, the lubrication performance of the lubricating groove is much more increased.

A variable displacement vane pump according to paragraph [0077], which is further characterized in that the lubricating groove is formed on the pressure plate at a portion of the pressure plate which is largely deformed when a pump discharge pressure is applied to the pressure plate, and at other portion of the pressure plate which is not so largely deformed, there is formed a seal surface that carries out a sealing against the inside surface of the rotor.

According to the invention, the lubricating groove is formed on the pressure plate at a portion that is largely deformed upon application of the pump discharge pressure to the pressure plate, and at a portion that is not largely deformed, there is formed a seal surface that carries out a sealing against the inside surface of the rotor. With this, by the lubricating groove, lubrication performance and sealing performance are both assured at the same time.

A variable displacement vane pump according to paragraph [0081], which is further characterized in that the seal surface is formed on the side of the discharge port.

According to the invention, since, at the side of the discharge port, both of the axially opposed portions of the pressure plate show a higher pressure and thus respective pressures at such opposed portions are kept balanced, the axial deformation of the pressure plate upon application of pressurized fluid thereto is relatively small. Accordingly, by providing the discharge port side with the above-mentioned seal surface, leakage of the working fluid from the back pressure groove can be suppressed.

A variable displacement vane pump according to paragraph [0081], which is further characterized in that the lubricating groove is positioned at a portion of the pressure plate where a pressure difference between axially opposed portions of the pressure plate is large, and at a portion of the pressure plate where the pressure difference is small, there is provided a seal surface that effects a sealing against the inside surface of the rotor.

According to the invention, at a portion where the pressure different between the axially opposed portions of the pressure plate is large, the deformation of the portion is increased since the pressure plate is biased in one axial direction by the pressure difference. Thus, by providing the portion with the lubricating groove, seizing between the pressure plate and rotor is effectively suppressed. While, at the other portion where the pressure difference is small, by providing the other portion with the seal surface, the leakage of the working fluid from the back pressure groove is suppressed while preventing the seizing between the pressure plate and the rotor.

A variable displacement vane pump according to paragraph [0081], which is further characterized in that the pressure plate is provided, at a side thereof facing the receiving space of the front body, with a seal member by which a high pressure portion and a low pressure portion are partitioned, and in that the seal surface is arranged at the low pressure portion defined by the seal member.

According to the invention, since, at the low pressure portion defined by the seal member, the axially opposed sides of the pressure plate show a low pressure keeping a balanced pressure condition therebetween, the axial deformation of the pressure plate is small. Accordingly, by providing the low pressure portion with the above-mentioned seal surface, the leakage of the working fluid from the back pressure groove is suppressed.

A variable displacement vane pump according to paragraph [0077], which is further characterized in that the pressure plate is produced by using a die forming technique.

According to the invention, since the pressure plate is produced by using the die forming technique, the shape of the lubricating groove can be freely set.

A variable displacement vane pump according to paragraph [0089], which is further characterized in that the pressure plate is produced by a sintered material.

According to the invention, since the sintered material is porous, the working fluid can be accumulated in the minute pores formed in the pressure plate, lubrication performance of the pressure plate relative to the rotor is further increased.

A variable displacement vane pump according to paragraph [0089], which is further characterized in that the pressure plate is produced by a die-cast aluminum material.

According to the invention, since the pressure plate is produced by the die-cast aluminum material, reduction in weight of entire construction of the device is achieved. Furthermore, by adding a suitable amount of anti-wear additive to the material of the aluminum die-cast, the wear resistance of the pressure plate to the rotor is controlled.

A variable displacement vane pump according to paragraph [0089], which is further characterized in that the lubricating groove has differently shaped portions in a circumferential direction.

According to the invention, the amount of the lubrication fluid can be varied or adjusted in a circumferential direction in accordance with the need of the fluid by portions, such as a portion that needs a larger amount of the fluid and a portion that needs only a small amount of the fluid.

A variable displacement vane pump according to paragraph [0095], which is further characterized in that the lubricating groove is arranged at only one part of a circumferentially extending imaginary line.

According to the invention, at a portion that needs lubrication, there is provided the lubricating groove, and at a portion that does not need lubrication, there is provided the seal surface without providing the lubricating groove. With this, lubrication performance and sealing performance are achieved at the same time.

A variable displacement vane pump according to paragraph [0095], which is further characterized in that the lubricating groove has a radial width that varies in accordance with positions in a circumferential direction.

According to the invention, for the portion that needs a larger amount of lubrication, the lubrication performance can be increased by increasing the radial width of the lubricating groove, and thus seizing between the pressure plate and the rotor can be suppressed, and for the portion that needs only a small amount of lubrication, the sealing performance can be increased by reducing the radial width of the lubricating groove, and thus leakage of the working fluid from the back pressure groove can be suppressed.

A variable displacement vane pump according to paragraph [0095], which is further characterized in that the lubricating groove is so shaped that the distance to the center varies depending on a position taken in a circumferential direction.

According to the invention, since the lubricating groove is so shaped that the distance to the center varies depending on a position taken in a circumferential direction, the lubrication performance and the sealing performance are suitably achieved.

The present invention is not limited to the construction of the above-mentioned embodiments, and is applicable to a construction wherein the shape, size, etc., of the intake ports 15 and 22, the discharge ports 19 and 24 and the back pressure grooves 41, 42, 47 and 48 are varied in accordance with the specification and size of the pump device.

Furthermore, by placing the narrow groove part 52 and the enlarged seal surface 53 of the above-mentioned second and third embodiments to their corresponding ranges "B", that is, by symmetrically placing them at upper and lower positions in FIGS. 9 and 10, the seal member 46 and the seal holding groove 45 may be removed.

In such cases, the narrow groove part 52 and the enlarged seal surface 53 are arranged in a circumferential range of the discharge range "B" where the pump discharge pressure is applied to both the axially opposed side surfaces 11*a* and 11*b* of the pressure plate 11 to achieve a balanced pressure condition in the axial direction, and the lubricating groove 44 is arranged in only a circumferential range other than the discharge range "B", where the pressure difference between the opposed side surfaces 11*a* and 11*b* is remarked. Thus, seizing of the sliding contact surface of the pressure plate 11 can be prevented suppressing the leakage of the pressurized fluid from the back pressure grooves 41 and 42. Furthermore, since there is no need of providing the seal member 46 and the seal holding groove 45, the cost of manufacturing can be reduced.

The lubricating groove 44 can have a generally arcuate cross section when viewed in a lateral direction. In this case, the flow resistance that appears when the pressurized fluid flows in the lubricating groove 44 can be reduced, and thus, the lubrication performance of the pressurized fluid flowing in the lubricating groove 44 can be increased.

Furthermore, the pressure plate 11 can be produced by a die-cast aluminum material. In this case, lightening of the entire construction of the pump device is achieved. Furthermore, by adding a suitable amount of anti-wear additive to the material of the aluminum die-cast, the wear resistance of the pressure plate to the rotor can be controlled.

DESCRIPTION OF THE REFERENCE NUMERALS

Figure 1:
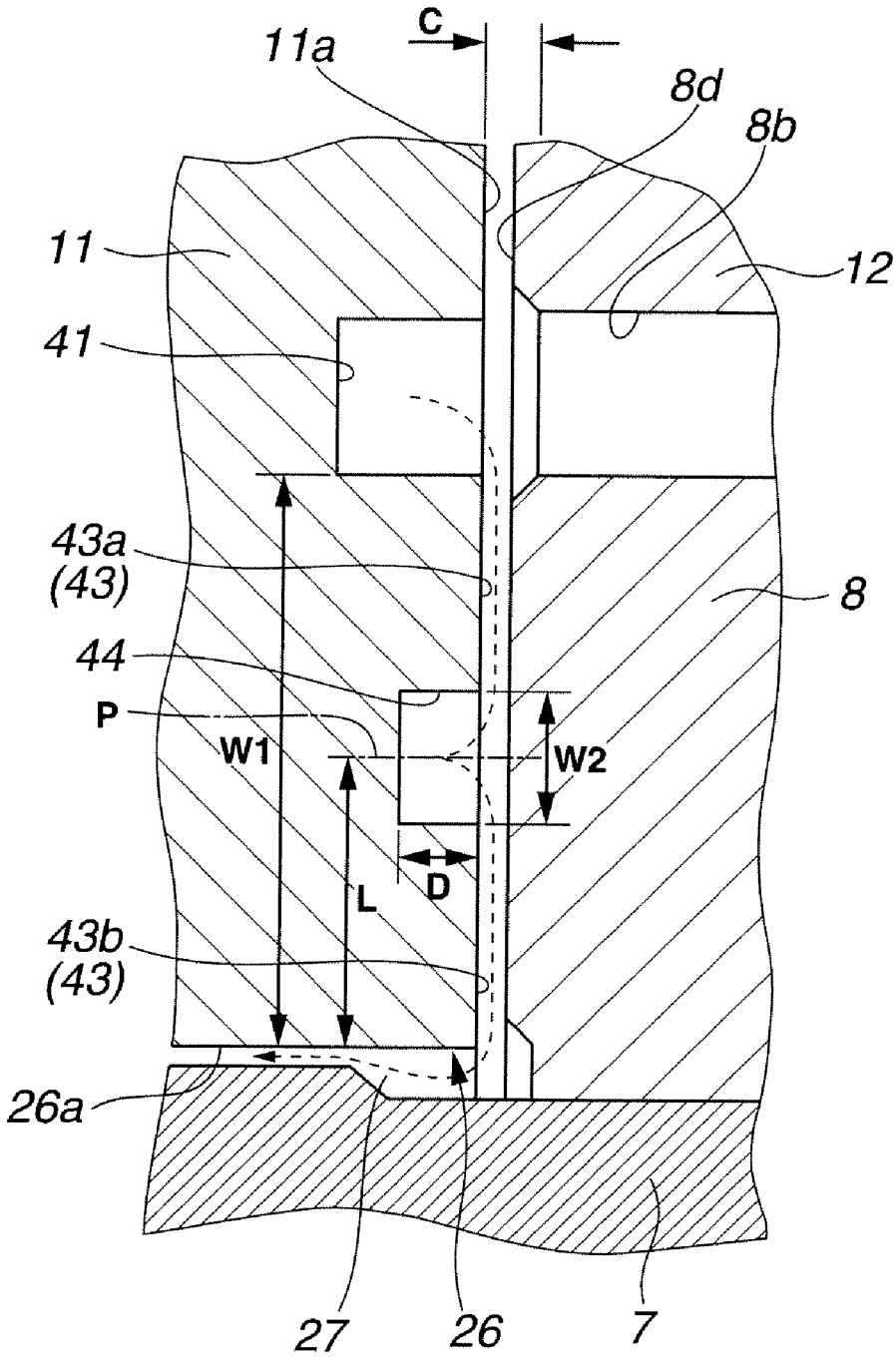
FIG. 1: A drawing showing a first embodiment of a variable displacement vane pump of the present invention, which is an enlarged view of an essential portion of FIG. 7.
Figure 2:
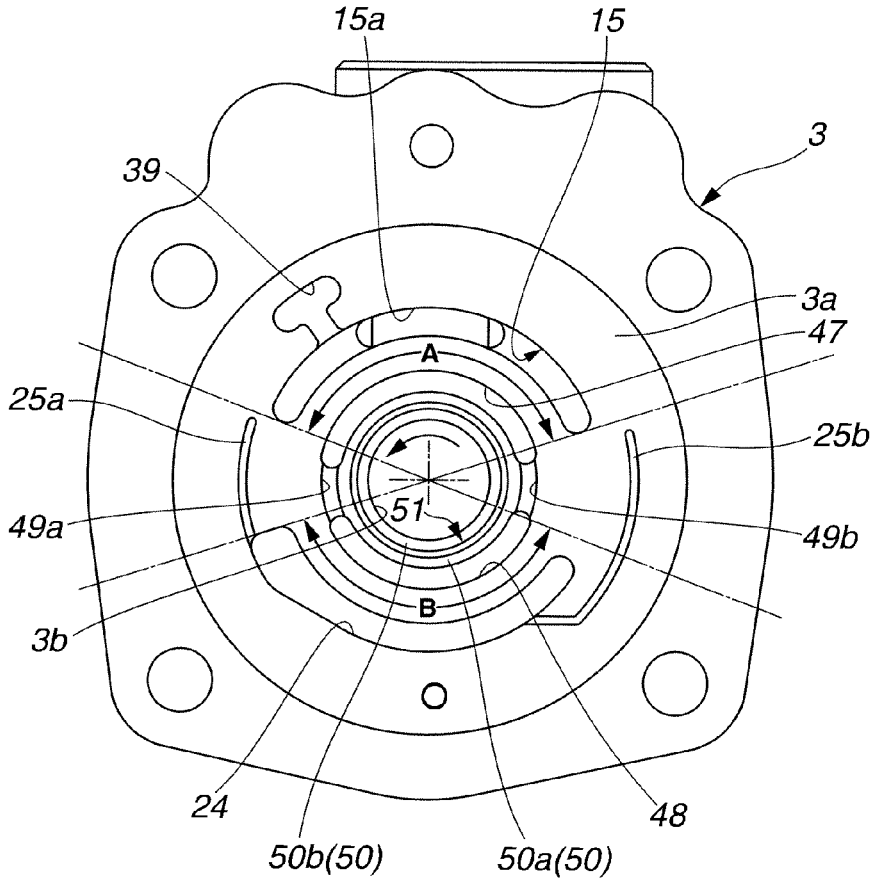
FIG. 2: A front view of a rear body of the variable displacement vane pump of the invention.
Figure 3:
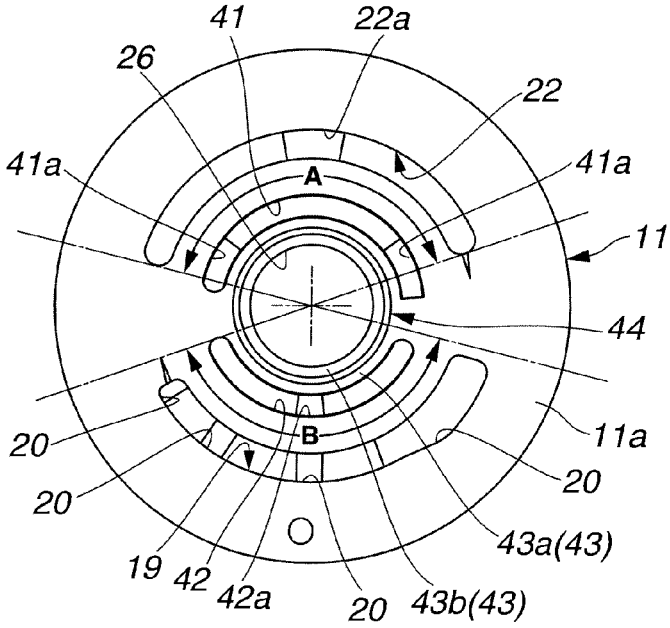
FIG. 3: A front view of a pressure plate of the variable displacement vane pump of the invention.
Figure 4:
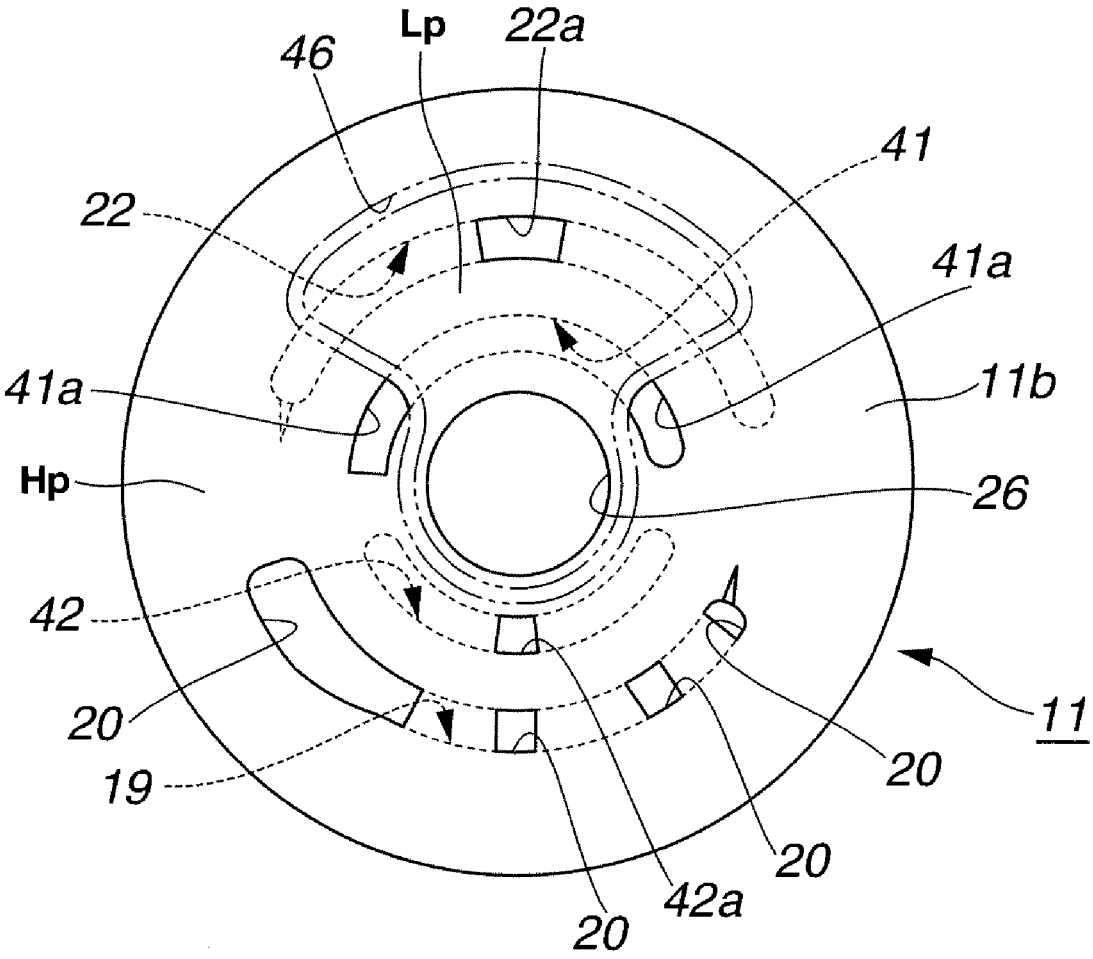
FIG. 4: A back view of the pressure plate of the variable displacement vane pump of the invention.
Figure 5:
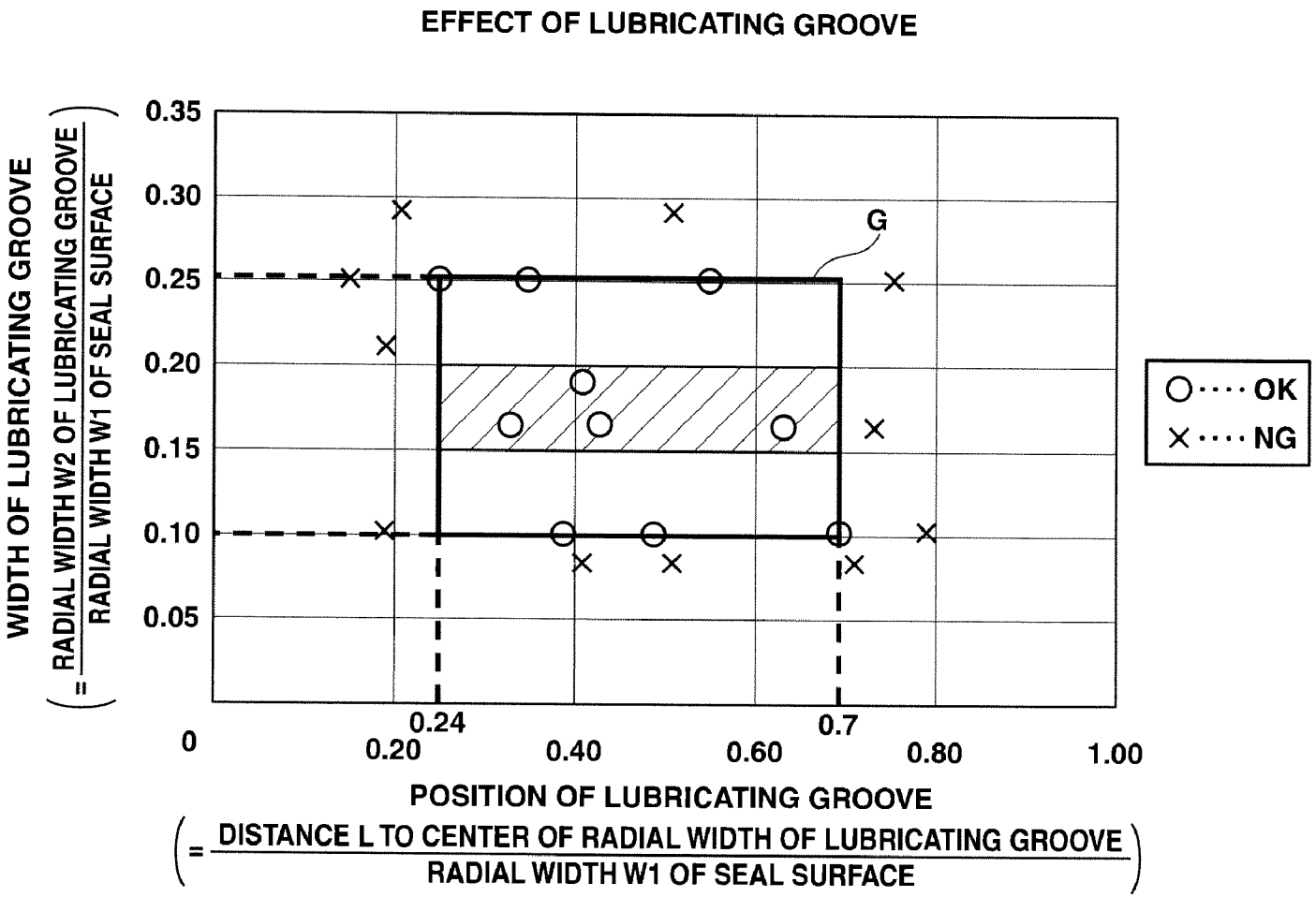
FIG. 5: A graph showing the results of a test carried out for examining a lubrication effect of a lubricating groove of the variable displacement vane pump of the invention in terms of a relation between a position of the groove and a width of the groove.
Figure 6:
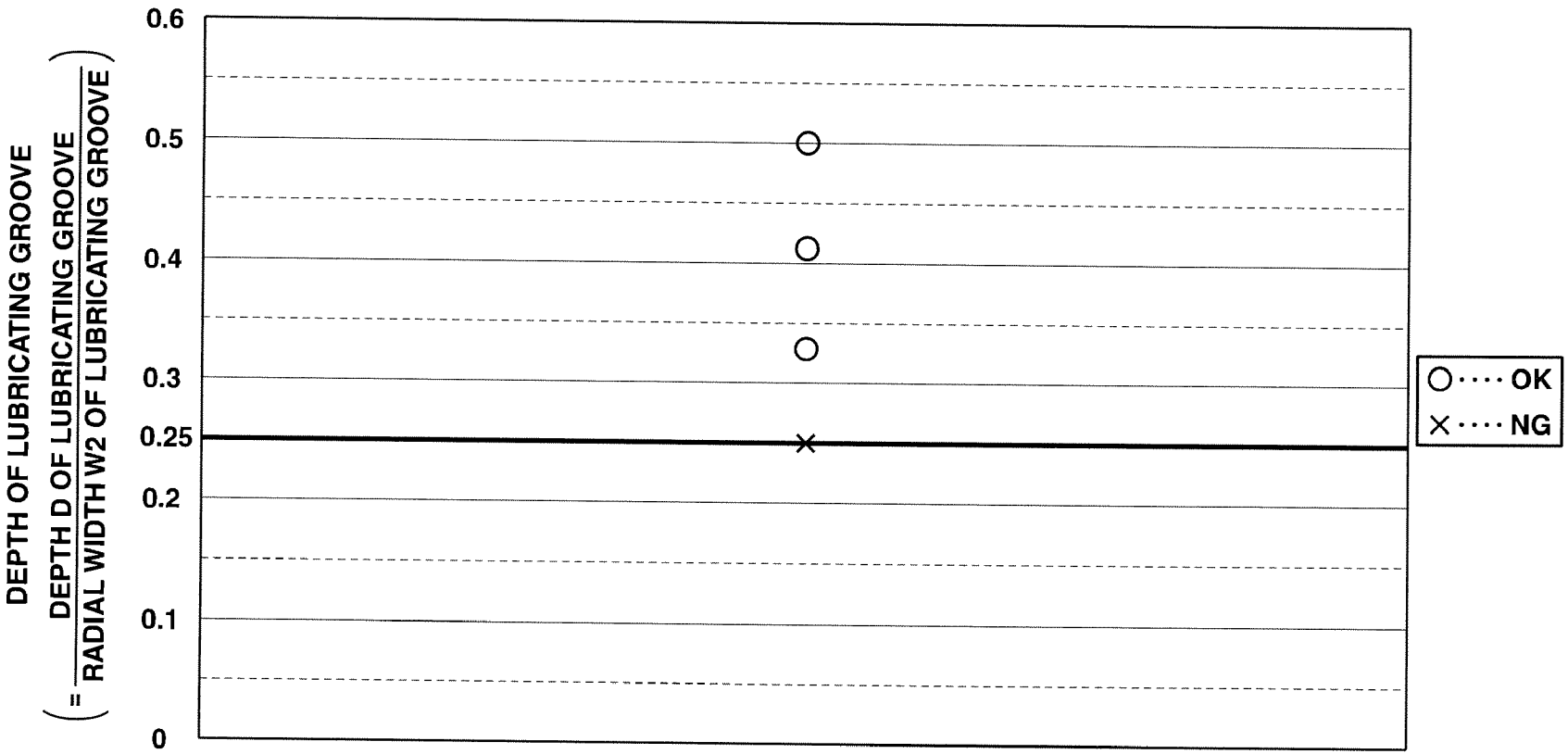
FIG. 6: A graph showing the results of a test carried out for examining a lubrication effect of the groove of the variable displacement vane pump of the invention with respect to a depth of the groove.
Figure 7:
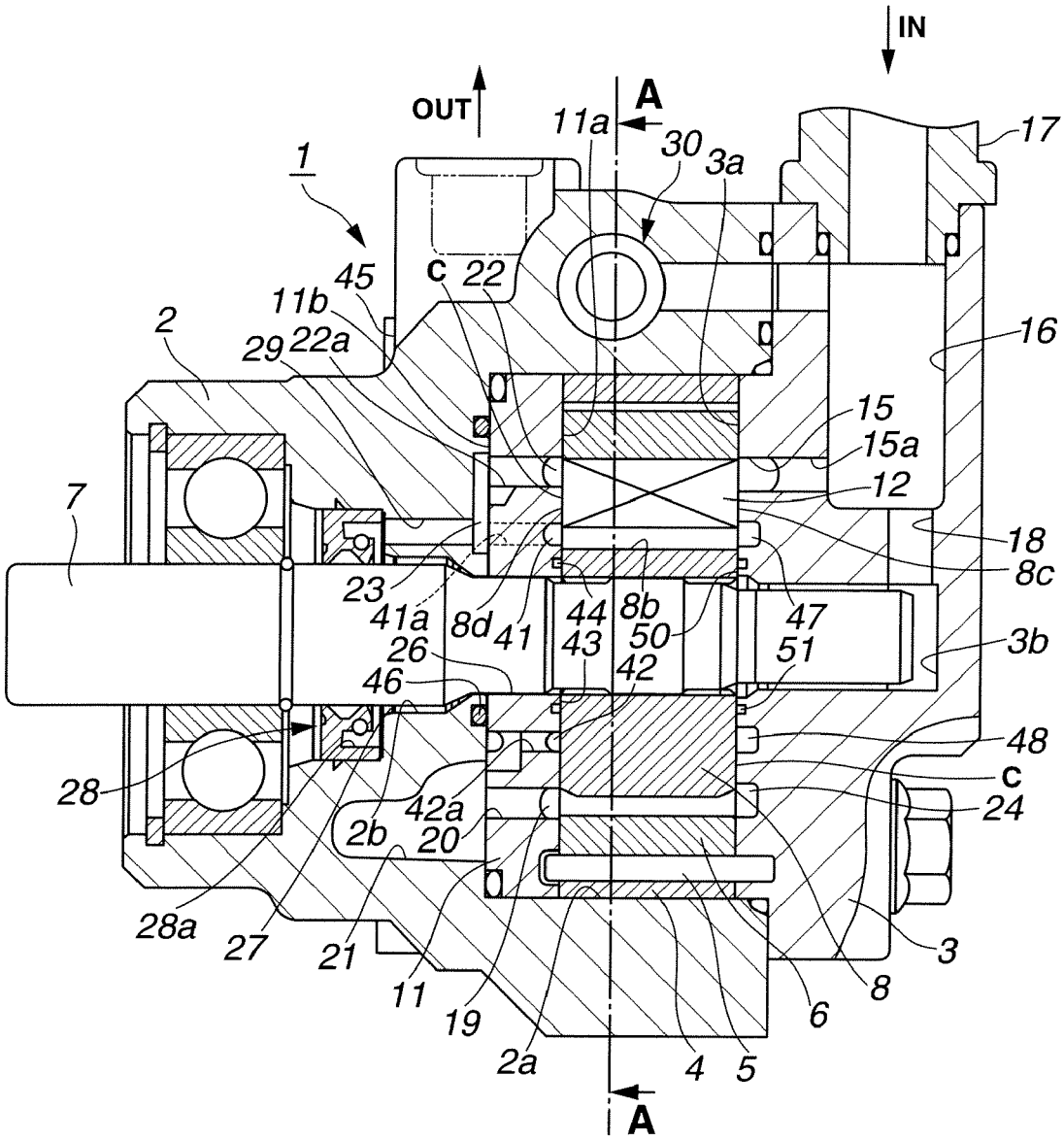
FIG. 7: A vertically sectioned view of the variable displacement vane pump of the invention.
Figure 8:
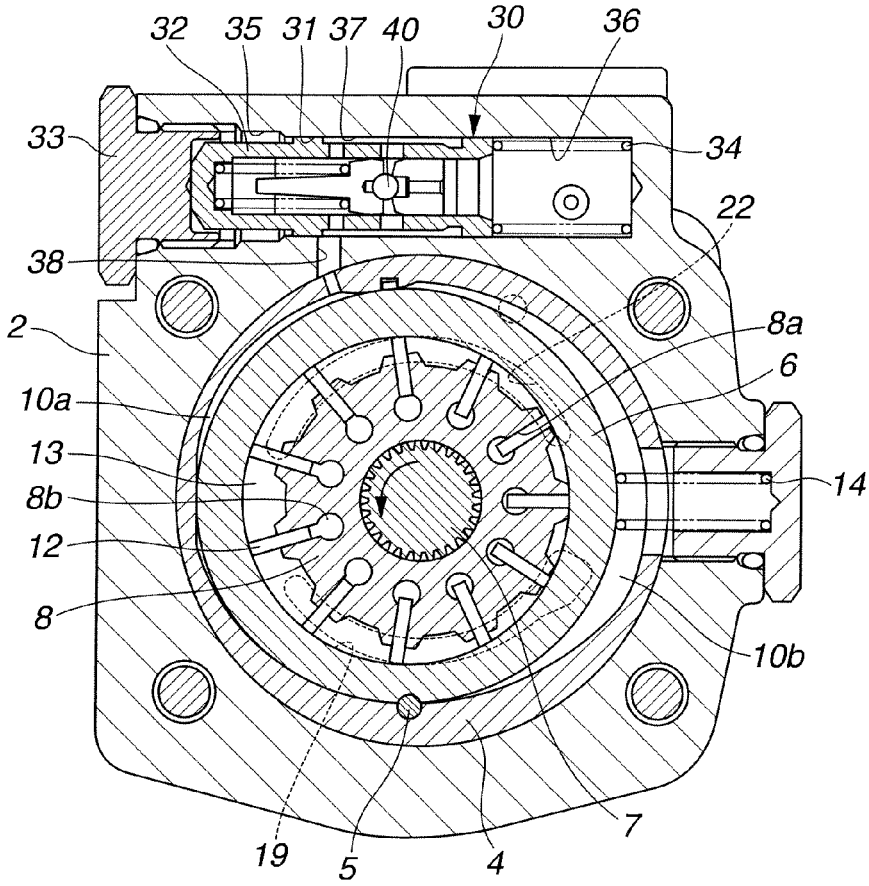
FIG. 8: A sectional view taken along the line A-A of FIG. 7.
Figure 9:
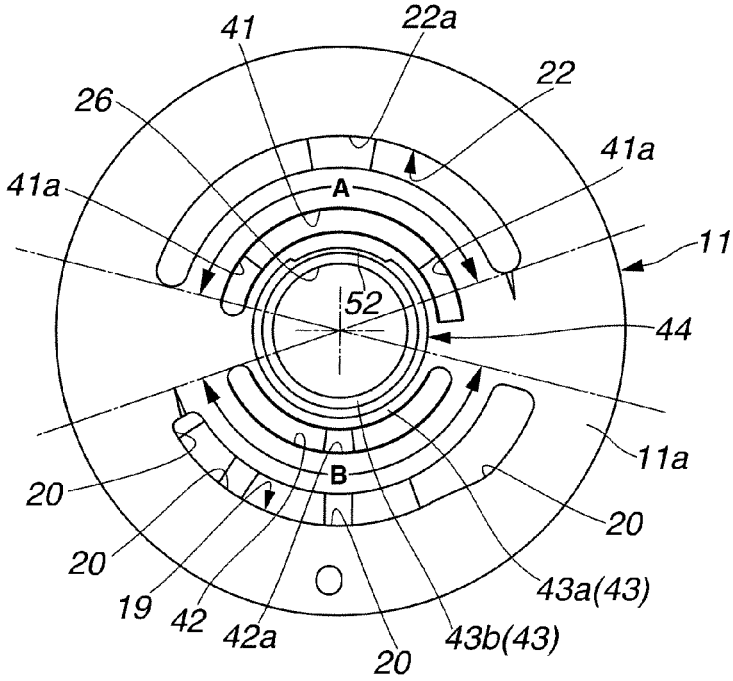
FIG. 9: A drawing showing a second embodiment of a variable displacement vane pump of the invention, with a front view of a pressure plate viewed from the side of a rotor.
Figure 10:
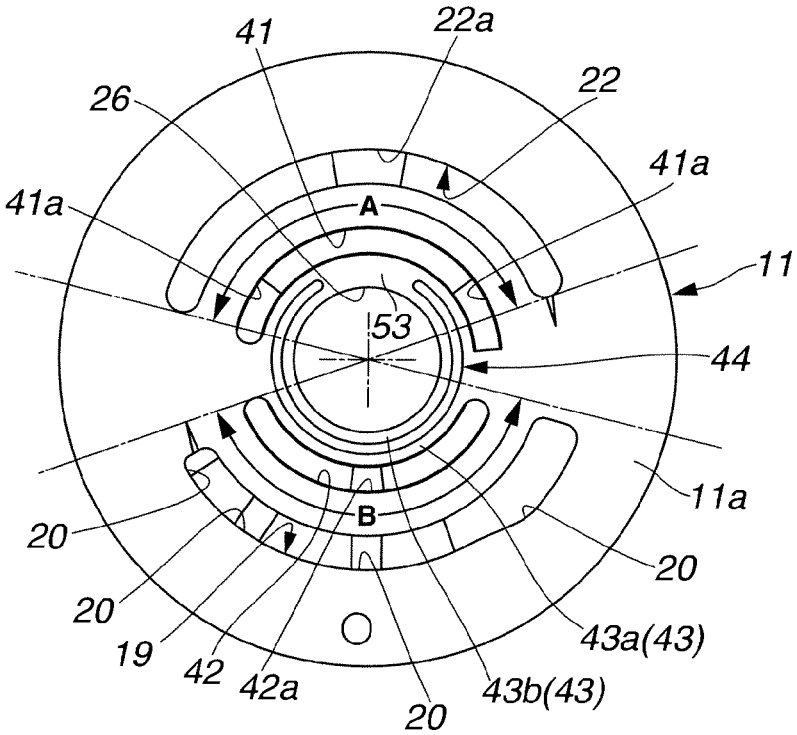
FIG. 10: A drawing showing a third embodiment of a variable displacement vane pump of the invention, with a front view of a pressure plate viewed from the side of a rotor.
Figure 11:
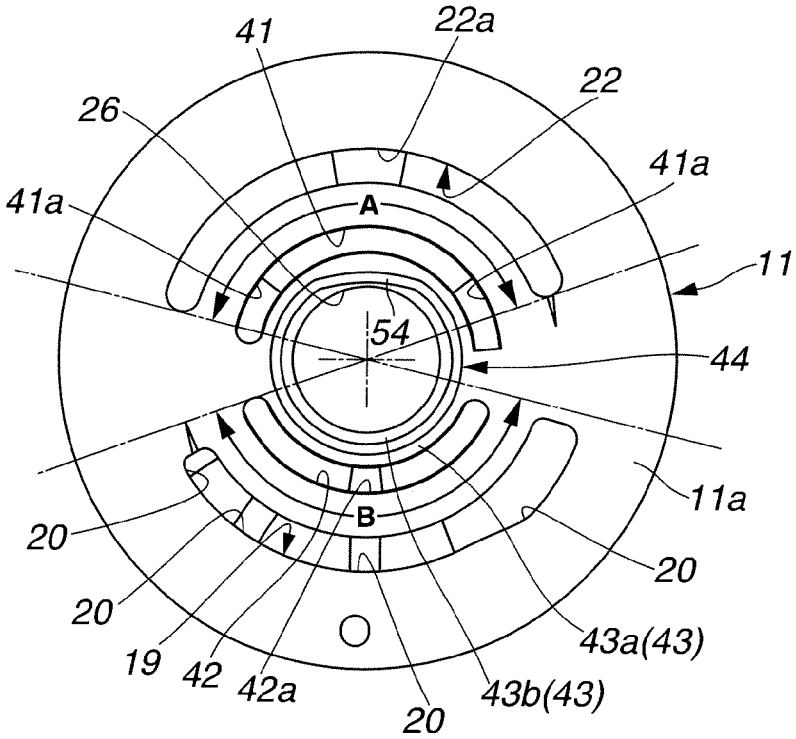
FIG. 11: A drawing showing a fourth embodiment of a variable displacement vane pump of the invention, with a front view of a pressure plate viewed from the side of a rotor.

1 . . . pump body
2 . . . front body
3 . . . rear body
3*a* . . . inside surface of rear body
6 . . . cam ring
7 . . . drive shaft
8 . . . rotor
8*a* . . . slot
8*d* . . . inside surface of rotor
10*a* . . . first fluid pressure chamber
10*b* . . . second fluid pressure chamber
11 . . . pressure plate
11*a* . . . inside surface of pressure plate
12 . . . vane
13 . . . pump chamber
15 . . . first intake port (intake port)
19 . . . first discharge port (discharge port)
22 . . . second intake port (intake port)
24 . . . second discharge port (discharge port)
26 . . . through opening
30 . . . flow control valve
41 . . . first intake side back pressure groove (back pressure groove)
42 . . . first discharge side back pressure groove (back pressure groove)
43 . . . seal surface
44 . . . lubricating groove
47 . . . second intake side back pressure groove (back pressure groove)
48 . . . second discharge side back pressure groove (back pressure groove)
L . . . distance to center P of radial width of lubricating groove
W1 . . . radial width of seal surface
W2 . . . radial width of lubricating groove
D . . . depth of lubricating groove

The invention claimed is:

1. A variable displacement vane pump comprising:

a pump body that includes a front body having a receiving space defined therein and a rear body attached to the front body to close the receiving space;

a drive shaft that passes through the pump body and rotatably supported in the same;

a rotor that is mounted on an outer cylindrical surface of the drive shaft and received in the receiving space;

a plurality of vanes that are retractably and projectably received in a plurality of slots formed in the rotor in a manner to extend radially outward;

a cam ring that is swingably arranged about the rotor to form a plurality of pump chambers, each pump chamber defined by adjacent two vanes, the rotor, and a part of the cam ring;

a pressure plate that is arranged in a manner to be put between inside surfaces of the rotor and cam ring and a bottom surface of the receiving space and biased toward and pressed against the inside surface of the rotor to slidably contact with the rotor by a pump discharge pressure led from the bottom surface of the receiving space;

first and second fluid pressure chambers that are formed around the cam ring to control an eccentric amount of the cam ring;

a pressure control means that controls the pressure in the first or second fluid pressure chamber; and an arrangement that includes:

an intake port that is provided by one of an inside surface of the rear body and an inside surface of the pressure plate facing the rotor and opened to a range where each pump chamber increases a volume;

a discharge port that is provided by the inside surface of the pressure plate and opened to a range where each pump chamber decreases the volume;

an axially extending through opening that is formed in the pressure plate for receiving the drive shaft;

a back pressure groove that is formed on the inside surface of the pressure plate at an area that slidably contacts the rotor to feed a pressurized fluid to bottom portions of the slots;

a seal surface that is formed between the back pressure groove and the axially extending through opening and slidably contacts with the inside surface of the rotor, and a circumferentially extending lubricating groove that is formed on the seal surface, wherein a radial width of the lubricating groove is set to a range from 10% to 25% of a radial width of the seal surface, and a distance from a center of the radial width of the lubricating groove to an inside cylindrical surface of the axially extending through opening is set to a range from 24% to 70% of the radial width of the seal surface.

2. A variable displacement vane pump as claimed in claim 1, wherein a depth of the lubricating groove is set to 25% or more of the radial width of the lubricating groove.

3. A variable displacement vane pump as claimed in claim 1, wherein the radial width of the lubricating groove is set to a range from 15% to 20% of the radial width of the seal surface.

4. A variable displacement vane pump as claimed in claim 3, wherein the distance from the center of the radial width of the lubricating groove to the inside cylindrical surface of the axially extending through opening is set to a range from 30% to 45% of the radial width of the seal surface.

5. A variable displacement vane pump as claimed in claim 1, wherein the distance from the center of the radial width of the lubricating groove to the inside cylindrical surface of the axially extending through opening is set to a range from 30% to 45% of the radial width of the seal surface.

* * * * *